US011745843B2

(12) United States Patent
Johansson

(10) Patent No.: US 11,745,843 B2
(45) Date of Patent: Sep. 5, 2023

(54) MOUNTING ARRANGEMENT FOR A PROPULSION UNIT

(71) Applicant: VOLVO PENTA CORPORATION, Gothenburg (SE)

(72) Inventor: Stig Johansson, Torslanda (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 274 days.

(21) Appl. No.: 17/297,892

(22) PCT Filed: Nov. 28, 2018

(86) PCT No.: PCT/EP2018/082891
§ 371 (c)(1),
(2) Date: May 27, 2021

(87) PCT Pub. No.: WO2020/108749
PCT Pub. Date: Jun. 4, 2020

(65) Prior Publication Data

US 2022/0055724 A1 Feb. 24, 2022

(51) Int. Cl.

| | |
|---|---|
| ***B63H 5/125*** | (2006.01) |
| ***B63H 20/22*** | (2006.01) |
| ***B63H 21/21*** | (2006.01) |

(52) U.S. Cl.
CPC ..... *B63H 5/125* (2013.01); *B63H 20/22* (2013.01); *B63H 2021/216* (2013.01)

(58) Field of Classification Search
CPC ... B63H 5/125; B63H 20/22; B63H 2021/216
See application file for complete search history.

(56) References Cited

U.S. PATENT DOCUMENTS 1,850,770 A * 3/1932 Witt ..... B63B 35/665 440/65
2,569,802 A * 10/1951 Daniels ..... B63H 5/1252 440/63

(Continued)

FOREIGN PATENT DOCUMENTS

| | | | |
|---|---|---|---|
| CN | 103582594 | A | 2/2014 |
| FR | 2923209 | A1 | 5/2009 |
| JP | 2013244913 | A | 12/2013 |

OTHER PUBLICATIONS

Chinese Office Action dated Mar. 3, 2022 in corresponding Chinese Patent Application No. 2018800993326.6, 7 pages.

(Continued)

*Primary Examiner* — Anthony D Wiest
(74) *Attorney, Agent, or Firm* — Venable LLP; Jeffri A. Kaminski

(57) ABSTRACT

The embodiments herein relate to amounting arrangement (100) for a propulsion unit. The mounting arrangement (100) comprises an attachment arrangement (133) adapted to attach said mounting arrangement (100) to a marine vessel. The mounting arrangement (100) comprises a propulsion unit carrying arrangement (110) adapted to be rigidly connectable to said propulsion unit. The propulsion unit carrying arrangement (110) is pivotably mounted to said attachment arrangement (133). The embodiments further relate to a marine propulsion system (200) comprising a propulsion unit (210) and the mounting arrangement (100). The propulsion unit (210) is rigidly connected to the propulsion unit carrying arrangement (100). An output shaft of the propulsion unit (210) is drivingly connectable to a shaft of a propeller drive (220). The marine propulsion system is pivotably mountable to a marine vessel. Embodiments further relate to a marine vessel (300) comprising a hull (302, 303, 304) and the marine propulsion system (200), the (Continued)

marine propulsion system (200) being pivotably mounted to the hull (302, 303, 304) of the marine vessel (300).

11 Claims, 6 Drawing Sheets

(56) References Cited

U.S. PATENT DOCUMENTS

| | | | | |
|---|---|---|---|---|
| 3,469,558 | A * | 9/1969 | Puretic | B63H 5/1252 440/53 |
| 3,752,111 | A | 8/1973 | Meynier, Jr. | |
| 5,441,388 | A | 8/1995 | Berger | |
| 2013/0323989 | A1 | 12/2013 | Derrah | |

OTHER PUBLICATIONS

International Search Report and Written Opinion dated Jul. 24, 2019 in corresponding International PCT Application No. PCT/EP2018/082891, 7 pages.

International Preliminary Report on Patentability dated Nov. 11, 2020 in corresponding International PCT Application No. PCT/EP2018/082891, 12 pages.

* cited by examiner

MOUNTING ARRANGEMENT FOR A PROPULSION UNIT

CROSS-REFERENCE TO RELATED APPLICATIONS

This application is a U.S. National Stage application of PCT/EP2018/082891, filed Nov. 28, 2018, and published on Jun. 4, 2020, as WO 2020/108749 A1, all of which is hereby incorporated by reference in its entirety.

TECHNICAL FIELD

Embodiments herein relate to a mounting arrangement, especially for marine drives, for pivotally mounting a propulsion unit to a marine vessel. Embodiments herein further relate to a marine propulsion system comprising the mounting arrangement.

BACKGROUND

Marine propulsion systems typically comprise a propulsion unit, such as a combustion engine or an electric motor connected to a propeller via a propeller drive. The propulsion systems are generally mounted inside a hull of a marine vessel, with the propeller drive protruding through the hull of the vessel with a certain inclination in relation to the hull of the vessel.

Installing the marine propulsion systems in the hull of the vessel is often time consuming since the propulsion unit and the propeller drive have to be individually mounted to the hull of the vessel and aligned to each other during or after the installation. In order to transfer the thrust forces generated by the propeller to the hull of the vessel the propulsion unit and the propeller drive are typically mounted to the hull at a plurality of mounting points.

The output shaft of the propulsion unit further has to be aligned with the propeller drive in order to reduce noise and vibrations caused by the propulsion system. The alignment is typically complex and requires individual adjustment of the height of the plurality of mounting points on the propulsion unit and/or the propeller drive until the output shaft of the propulsion unit is properly aligned with a propeller shaft of the propeller drive.

SUMMARY

The embodiments herein aim to overcome the above mentioned problems relating to the installation and alignment of a propulsion system in a marine vessel. The embodiments herein in particular aim to provide a mounting arrangement, which is simple, robust and easy to install.

This is achieved by means of a mounting arrangement for a propulsion unit. The mounting arrangement comprises an attachment arrangement adapted to attach said mounting arrangement to a marine vessel. The mounting arrangement further comprises a propulsion unit carrying arrangement adapted to carry said propulsion unit such that said propulsion unit is rigidly attached to said propulsion unit carrying arrangement. The propulsion unit carrying arrangement is pivotably connected to said attachment arrangement. By pivotably connecting the propulsion unit carrying arrangement to the attachment arrangement, the angle of inclination between the attachment arrangement and the propulsion unit carrying arrangement can be continuously adapted. Thereby an alignment of a propulsion unit is facilitated when the propulsion unit is connected to said propulsion unit carrying arrangement.

Optionally, the mounting arrangement may further comprise a pivoting arrangement, for obtaining the pivotable connection between the propulsion unit carrying arrangement and the attachment arrangement. The pivoting arrangement may comprise a first pivoting element forming part of the propulsion unit carrying arrangement and a second pivoting element forming part of the attachment arrangement. The first and second pivoting elements are pivotably connected to each other, such that the propulsion unit carrying arrangement is pivotable in relation to the attachment arrangement by means of the first and second pivoting elements.

Optionally, the first pivoting element may be an axle, and the second pivoting element may comprise a tubular sleeve for receiving the axle. The axle and the tubular sleeve have the benefit that they enable the axle to rotate in relation to the tubular sleeve around a central axis of the axle, while a movement of the axle in relation to the tubular sleeve is prevented in a radial direction of the axle. Thereby the first and second pivoting elements can counteract a torque generated by the propulsion unit when the propulsion unit is connected to the propulsion unit carrying arrangement.

Optionally, the second pivoting element may be the axle, and the first pivoting element may comprise the tubular sleeve for receiving the axle.

Optionally, the pivoting arrangement may further comprise a flexible element for separating the first pivoting element from the second pivoting element, when the first pivoting element is connected to the second pivoting element. The flexible element has the benefit that vibrations and noise will be absorbed by the flexible element. When the mounting arrangement is comprised in a propulsion unit mounted in a marine vessel, the flexible element reduces the noise and vibrations transferred from the propulsion unit and the propeller drive to the vessel.

Optionally, the propulsion unit carrying arrangement may be adapted to receive a propeller shaft of a propeller drive, such that the propeller shaft is drivingly connectable to said propulsion unit.

Optionally, the pivoting arrangement may be arranged such that a pivot axis of the pivoting arrangement is arranged perpendicular to a rotation axis of the propeller shaft when the propeller shaft is drivingly connected to the propulsion unit. By arranging the pivot axis perpendicular to the rotation axis of the propeller shaft, the inclination of the propulsion unit towards the propeller shaft can be adapted while the torque from the propulsion unit and the thrust force from the propeller drive acting in an axial direction of the propeller shaft are counteracted by the pivoting arrangement.

Optionally, the attachment arrangement may comprise two attachment members and two pivoting arrangements. The pivoting arrangements may be arranged on opposite sides of the propulsion unit carrying arrangement. The pivot axes of the two pivoting arrangements may be arranged collinear to each other and perpendicular to a rotation axis of the propeller shaft, when the propeller shaft is drivingly connected to said propulsion unit when mounted on the propulsion unit carrying arrangement. This provides a balanced load distribution on the mounting arrangements and allows a drive shaft to be routed through the propulsion unit carrying arrangement centrally in between the two attachment members. By arranging the two pivoting arrangements collinearly, both pivoting arrangements share a common pivot axis which allows the propulsion unit carrying arrangement to pivot freely around the pivot axis.

Optionally, the pivot axis may intersect the rotation axis of the propeller shaft, when the propeller shaft is drivingly connected to said propulsion unit and the propulsion unit is mounted to the propulsion unit carrying arrangement. When the pivot axis intersects the rotation axis of the propeller shaft a thrust force caused by the thrust from the propeller and acting in axial direction of the propeller shaft drive will be acting centrally on the pivot elements. Since the thrust force acts centrally on the pivot axis of the pivot elements and not at a distance from the pivot axis of the pivot elements, the thrust force will not create a torque around the pivot axis which torque would cause a rotation of the propulsion unit carrying arrangement around the pivot axis.

Optionally, the propulsion unit carrying arrangement may comprise a drive arrangement. The drive arrangement may comprise an input shaft being drivingly connectable to an output shaft of the propulsion unit and an output shaft being drivingly connectable to the shaft of the propeller drive. The input shaft and the output shaft may be drivingly connected to each other.

Optionally, the drive arrangement may comprise a gearing arranged between the input shaft and the output shaft. The gearing allows a speed and/or torque ratio between the input shaft and the output shaft to be changed.

Also disclosed is a marine propulsion system. The marine propulsion system comprises a propulsion unit and the mounting arrangement described above. The propulsion unit carrying arrangement carries said propulsion unit such that said propulsion unit is rigidly attached to said propulsion unit carrying arrangement. An output shaft of the propulsion unit is drivingly connectable to a propeller shaft. Since the propulsion unit of the marine propulsion system is pivotably mounted to the attachment arrangement of the mounting arrangement, the angle of inclination of the propulsion unit in relation to the mounting arrangement may be adapted.

Optionally, the marine propulsion system may further comprise a propeller drive, which in turn comprises a propeller shaft. An output shaft of the propulsion unit is drivingly connected to said propeller shaft.

Optionally, the propulsion unit may be an electric motor, a combustion engine or a hydraulic motor.

Also disclosed is a marine vessel comprising a hull and the marine propulsion system described above. The marine propulsion system is pivotably mounted to the hull of the marine vessel. Thereby the angle of inclination of the propulsion unit in relation to the hull of the marine vessel and/or to the propeller drive may be adapted in order to align a rotation axis of the propulsion unit with a rotation axis of the propeller drive.

The embodiments herein provide numerous benefits and advantages over existing solutions in that they provide a simple and robust mounting arrangement which facilitates an installation and alignment of a marine propulsion system in a marine vessel. The proposed mounting arrangement has a simple and compact mechanical construction and allows the angle of inclination of the propulsion unit to be continuously variable within a specified range of angles.

BRIEF DESCRIPTION OF THE DRAWINGS

In the following, embodiments herein will be described in greater detail by way of example only with reference to the attached drawings, in which.

Still other objects and features of embodiments herein will become apparent from the following detailed description considered in conjunction with the accompanying drawings. It is to be understood, however, that the drawings are designed solely for purposes of illustration and not as a definition of the limits hereof, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION

Figure 1:
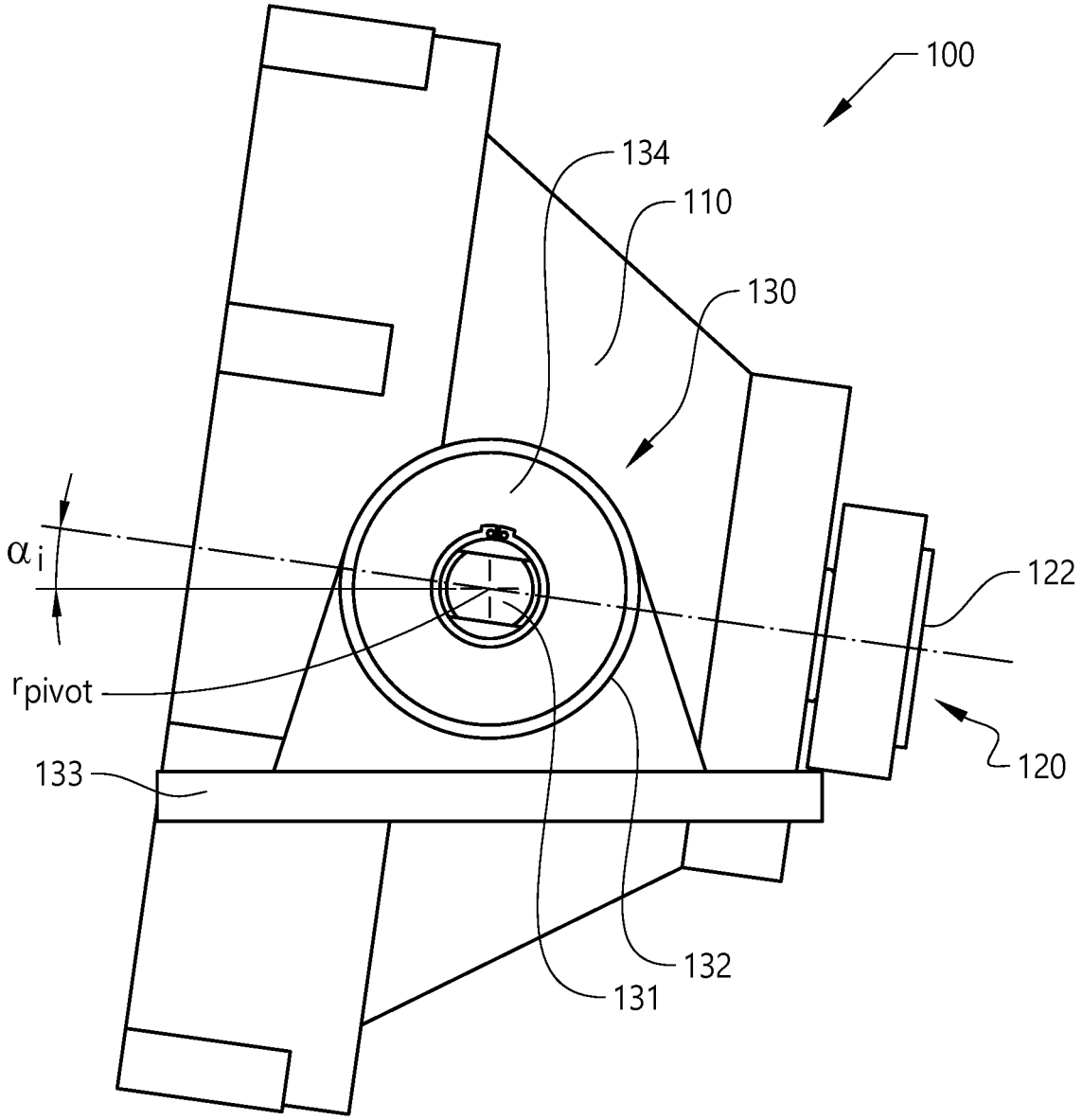
FIG. 1 is an illustration of the mounting arrangement for a propulsion unit according to some embodiments herein seen in the direction of a pivot axis.

FIG. 1 shows a side view of the mounting arrangement 100 for a propulsion unit according to some embodiments herein. The mounting arrangement 100 comprises an attachment arrangement 133 adapted to attach said mounting arrangement 100 to a surface, such as e.g. a marine vessel, and a propulsion unit carrying arrangement 110 adapted to carry said propulsion unit, such that said propulsion unit is rigidly attached to said propulsion unit carrying arrangement 110. The propulsion unit carrying arrangement 110 is pivotably connected to said attachment arrangement 133.

The mounting arrangement 100 may comprise a pivoting arrangement 130 for obtaining the pivotable connection between the propulsion unit carrying arrangement 110 and the attachment arrangement 133. The pivoting arrangement 130 may comprise a first pivoting element 131 forming part of the propulsion unit carrying arrangement 110 and a second pivoting element 132 forming part of the attachment arrangement 133. The first and second pivoting elements 132, 133 are rotatably connected to each other, such that the propulsion unit carrying arrangement 110 is pivotable in relation to the attachment arrangement 133 by means of the first and second pivoting elements 131, 132 rotating in relation to each other. As shown in FIG. 1 the first pivoting element 131 may comprise an axle and the second pivoting element 132 may comprise a tubular sleeve for receiving the axle. Alternatively, the second pivoting element 132 may comprise an axle, and the first pivoting element 131 may comprise a tubular sleeve for receiving the axle. The pivoting arrangement 130 allows the inclination of the propulsion unit carrying arrangement 110 to be adjusted in relation to the attachment arrangement 133. When the attachment arrangement is mounted to a surface, such as e.g. a surface of a marine vessel, this allows for the inclination of the propulsion unit carrying arrangement 110 to be adjusted in relation to the surface. The angle of the inclination may be varied in a predetermined range, such as e.g. in the range of −30° to 30°, preferably in the range of 0° to 20°.

The mounting arrangement may further comprise a flexible element 134 for reducing vibrations in the mounting arrangement 100. The flexible element 134 may e.g. be comprised in the pivoting arrangement 130, and may be arranged to separate the first pivoting element 131 from the second pivoting element 132. As shown in FIG. 1 the flexible element 130 may be arranged between the tubular sleeve and the axle, such that a centerline of the flexible element coincides with the pivot axis $r_{pivot}$. The flexible element 134 may e.g. be a rubber bushing. The flexible element may be tuned, e.g. by changing the stiffness of the flexible element, to absorb noise and vibrations from the propulsion unit and the propeller drive when the propulsion unit and the propeller drive are drivingly connected to the mounting arrangement 100.

The attachment arrangement 133 may further be adapted to provide an adjustment of a distance between a mounting surface of the attachment arrangement 133 and the second pivoting element 132, wherein the mounting surface of the attachment arrangement 133 is the surface of the attachment arrangement 133 which abuts the surface to which the mounting arrangement 133 is to be mounted to. When the attachment arrangement 133 is mounted to a vessel the mounting surface is the surface of the attachment arrangement 133 which faces the vessel. The attachment arrangement 133 may e.g. comprise a first and a second part being slidably arranged to each other in a direction of adjustment. The first part may comprise the second pivoting element 132 and the second part may comprise the mounting surface, such that the first and the second part may be slidably moved in relation to each other in order to change the distance between the second pivoting element 132 and the mounting surface. Thereby the height of the pivoting arrangement 130 in relation to the surface to which the attachment arrangement 133 is mounted may be adapted, which further facilitates the alignment of the propulsion unit to the propeller shaft of the propeller drive. The attachment arrangement 133 may further comprise securing elements for securing the first and the second part to each other once the correct distance between the second pivoting element 132 and the mounting surface has been set. In a further embodiment, the attachment arrangement 133 may comprise adjustable mounting elements (not shown in FIG. 1) for mounting the attachment arrangement 133 to a surface, such as e.g. a marine vessel. The adjustable mounting elements and the attachment arrangement 133 may e.g. comprise threads, such that the mounting elements and the attachment arrangement 133 can be moved in relation to each other by turning the mounting elements in relation to the attachment arrangement 133 such that the thread causes the mounting elements to move in relation to the attachment arrangement in the direction of adjustment. Thereby the distance between the mounting elements and the attachment arrangement 133 may be changed, which also causes the distance between the second pivoting element 132 and the surface, such as e.g. the marine vessel, to which the attachment arrangement 133 is to be mounted to change.

Figure 2:
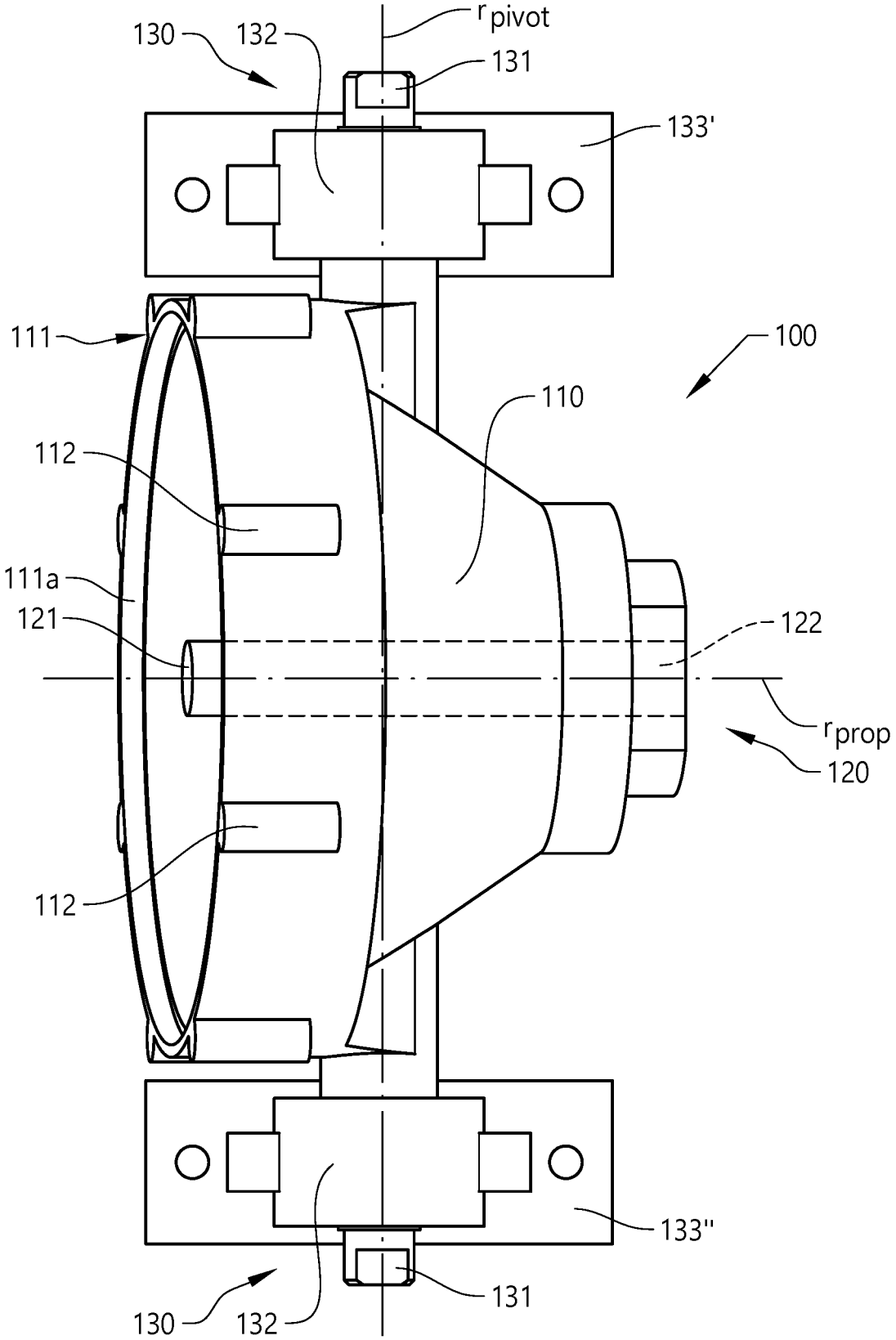
FIG. 2 is an illustration of the mounting arrangement for the propulsion unit according to some embodiments herein seen from a top-down view in a direction perpendicular to the pivot axis.

FIG. 2 shows a top-down view of the mounting arrangement 100 of FIG. 1. The propulsion unit carrying arrangement may comprise a propulsion unit receiving portion 111. In the embodiment shown in FIG. 2, the propulsion unit receiving portion 111 comprises a flange 111*a* and a plurality of fastening means 112 for connecting the propulsion unit to the propulsion unit carrying arrangement 110. The propulsion unit carrying arrangement 110 may be adapted to receive a propeller shaft of a propeller drive (not shown in FIG. 2), such that the propeller shaft is drivingly connectable to said propulsion unit when the propulsion unit (not shown in FIG. 2) is mounted to the propulsion unit carrying arrangement 110. The propulsion unit carrying arrangement 110 may e.g. be adapted to receive the propeller shaft by comprising a tubular through hole for receiving an output shaft of the propulsion unit and/or the propeller shaft, thereby enabling the propeller drive to be directly connected to the propulsion unit, when the propulsion unit is mounted to the propulsion unit carrying arrangement 110. The centerline of the tubular through hole may be collinearly arranged with the propeller shaft when the propeller shaft is drivingly connected to the propulsion unit. The centerline of the cylindrical through hole thereby coincides with a rotation axis $r_{prop}$ of the propeller shaft.

In the embodiment shown in FIG. 2, the attachment arrangement 133 comprises two attachment members 133', 133" and two pivoting arrangements 130. The pivoting arrangements 130 are arranged on opposite sides of the propulsion unit carrying arrangement 110. The pivot axes of the two pivoting arrangements 130 are arranged collinear to each other and perpendicular to a rotation axis $r_{prop}$ of the propeller shaft when the propulsion unit is connected to the mounting arrangement 110 and the propeller shaft is drivingly connected to the propulsion unit.

The mounting arrangement 100 may be such that the propulsion unit carrying arrangement 110 is adapted to pivot relative to said attachment arrangement (133) around a pivot axis, herein referred to as $r_{pivot}$, being perpendicular to the centerline of the tubular through hole and/or a rotation axis $r_{prop}$ of the propeller shaft when the propeller shaft is drivingly connected to said propulsion unit. When the propulsion unit carrying arrangement 110 comprises the drive arrangement 120, the pivot axis $r_{pivot}$ of the pivoting arrangement will thus be arranged perpendicular to the output shaft 122 of the drive arrangement 120 which is adapted to be connected to the propeller shaft, e.g. by means of a propeller shaft flange The pivot axis may be arranged perpendicular to the rotation axis $r_{prop}$ of the propeller shaft at a radial distance from each other, which may also be referred to as being arranged with an offset to each other. In some embodiments the pivot axis $r_{pivot}$ may be arranged to intersect the centerline of the tubular through hole and/or the rotation axis $r_{prop}$ of the propeller shaft when the propeller shaft is drivingly connected to said propulsion unit. The pivot axis being arranged to intersect shall herein be interpreted as the distance between the pivot axis and the centerline of the tubular through hole being zero, which may also be referred to as the axes being arranged without offset. Arranging the pivoting arrangement 130 in such a way that the pivot axis intersects the rotation axis $r_{prop}$ of the propeller shaft has the benefit that thrust forces from the propeller drive are acting on the pivoting elements 131, 132 at zero offset from the pivot axis $r_{pivot}$. Since the forces are acting with zero offset there is no lever arm that will cause the force to create a torque around the pivot axis $r_{pivot}$ which would cause the propulsion unit carrying arrangement 110 to pivot around the pivot axis $r_{pivot}$. Thereby the alignment of the propulsion unit carrying arrangement 110 and the propulsion unit connected thereto will not be affected by the thrust force generated by the propeller drive when the propeller drive is drivingly connected to the propulsion unit mounted on the mounting arrangement.

Figure 3:
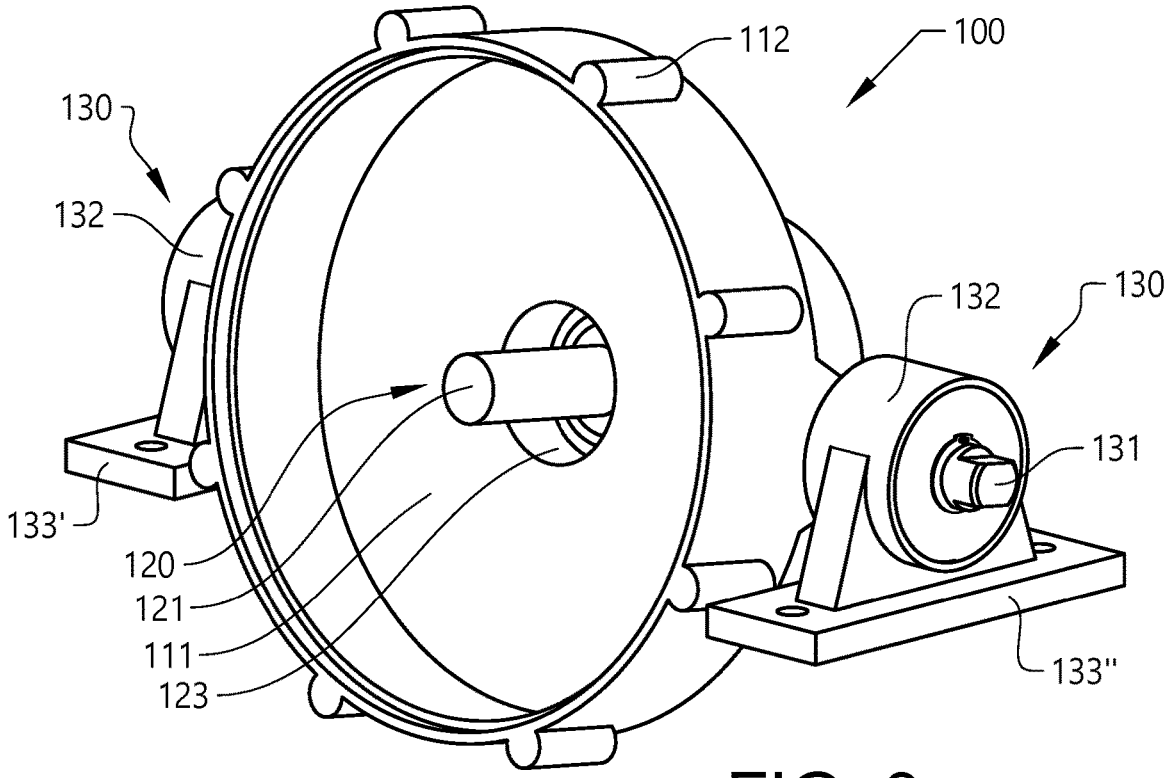
FIG. 3 is an illustration of the mounting arrangement for the propulsion unit according to some embodiments herein seen in perspective from a side adapted to be connected to the propulsion unit.

The propulsion unit carrying arrangement 110 may in some embodiments herein comprise a drive arrangement 120 being rotatably arranged in the propulsion unit carrying arrangement 110. FIG. 3 shows a perspective view of the propulsion unit carrying arrangement 110 seen from a side adapted to be connected to the propulsion unit, wherein the propulsion unit carrying arrangement 110 comprises one example of such a drive arrangement 120. The drive arrangement 120 as shown in FIG. 3 comprises an input shaft 121 being drivingly connectable to an output shaft of the propulsion unit and an output shaft 122 being drivingly connectable to the propeller shaft. The input shaft 121 and the output shaft 122 may be drivingly connected to each other. The input shaft 121 and the output shaft 122 may e.g. be one integral part, or two separate shafts connected via torque transferring means, such as e.g. a gear or a clutch. As shown in FIG. 3 the propulsion unit carrying arrangement 110 may further comprise the tubular through hole 123 for allowing the input shaft 121 and/or output shaft 122 to extend through the propulsion unit carrying arrangement 110. The propulsion unit carrying arrangement 110 further comprise the propulsion unit receiving portion 111 for mounting the propulsion unit to the propulsion unit carrying arrangement 110. The propulsion unit receiving portion 111 comprises one or more fastening means 112 for fastening the propulsion unit to the propulsion unit carrying arrangement 110.

Figure 4:
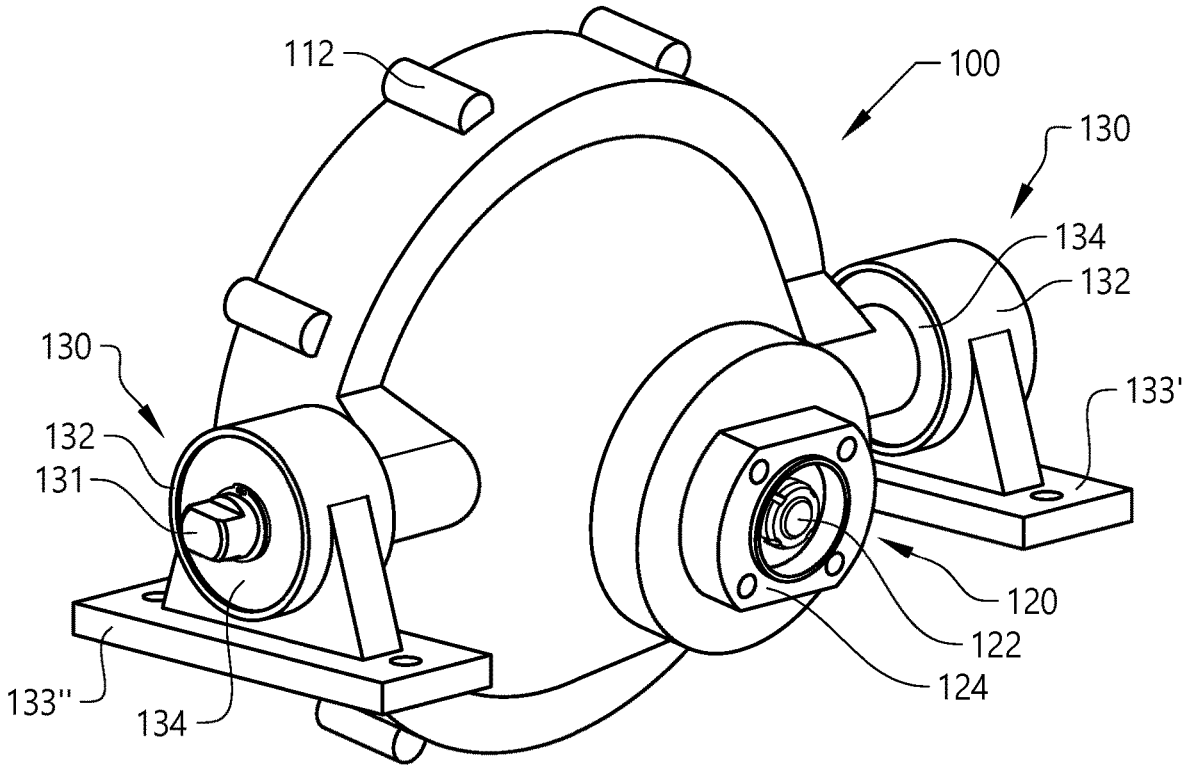
FIG. 4 is an illustration of the mounting arrangement for the propulsion unit according to some embodiments herein seen in perspective from a side adapted to receive a propeller shaft.

FIG. 4 shows a perspective view of the propulsion unit carrying arrangement 110 according to FIG. 3 seen from a side being adapted to receive the propeller shaft. FIG. 4 shows the output shaft 122 of the drive arrangement 120 extending through the propulsion unit carrying arrangement 110. The output shaft 122 may e.g. comprise a propeller shaft flange 124 being adapted to be connected to a corresponding flange on the propeller shaft.

Although the propulsion unit carrying arrangement 110 according to FIG. 3 and FIG. 4 comprises a drive arrangement 120, the propulsion unit carrying arrangement 110 may also be adapted to allow the propeller shaft to be directly connected to the propulsion unit, when the propulsion unit is mounted to the propulsion unit carrying arrangement 110. In one embodiment the output shaft of the propulsion unit may extend through the tubular through hole 123, thereby allowing the propeller shaft to be connected directly to the output shaft of the propulsion unit. According to a further embodiment the propeller shaft may extend through the tubular through hole 123, thereby allowing the propeller shaft to be connected directly to the output shaft of the propulsion unit.

The propulsion unit carrying arrangement 110 may further comprise a thrust bearing for supporting axial loads acting on the propulsion unit carrying arrangement 110. The axial loads are typically generated by the propeller drive 220 when the propeller drive 220 is driven by the propulsion unit 220 to propel the vessel through water. The thrust bearing shall herein be interpreted as a rotary bearing which permits a rotation between two parts, such as e.g. between the propeller shaft and the propulsion unit carrying arrangement 110, and is designed to support a high axial load parallel to the shaft during the rotation. The thrust bearing may be arranged in the tubular through hole 123 of the propulsion unit carrying arrangement 110, such that when a shaft is inserted into the through hole 123 the shaft is brought into axial contact with the thrust bearing. Thereby axial loads generating from the shaft is transferred via the thrust bearing to the propulsion unit carrying arrangement 110.

Figure 5:
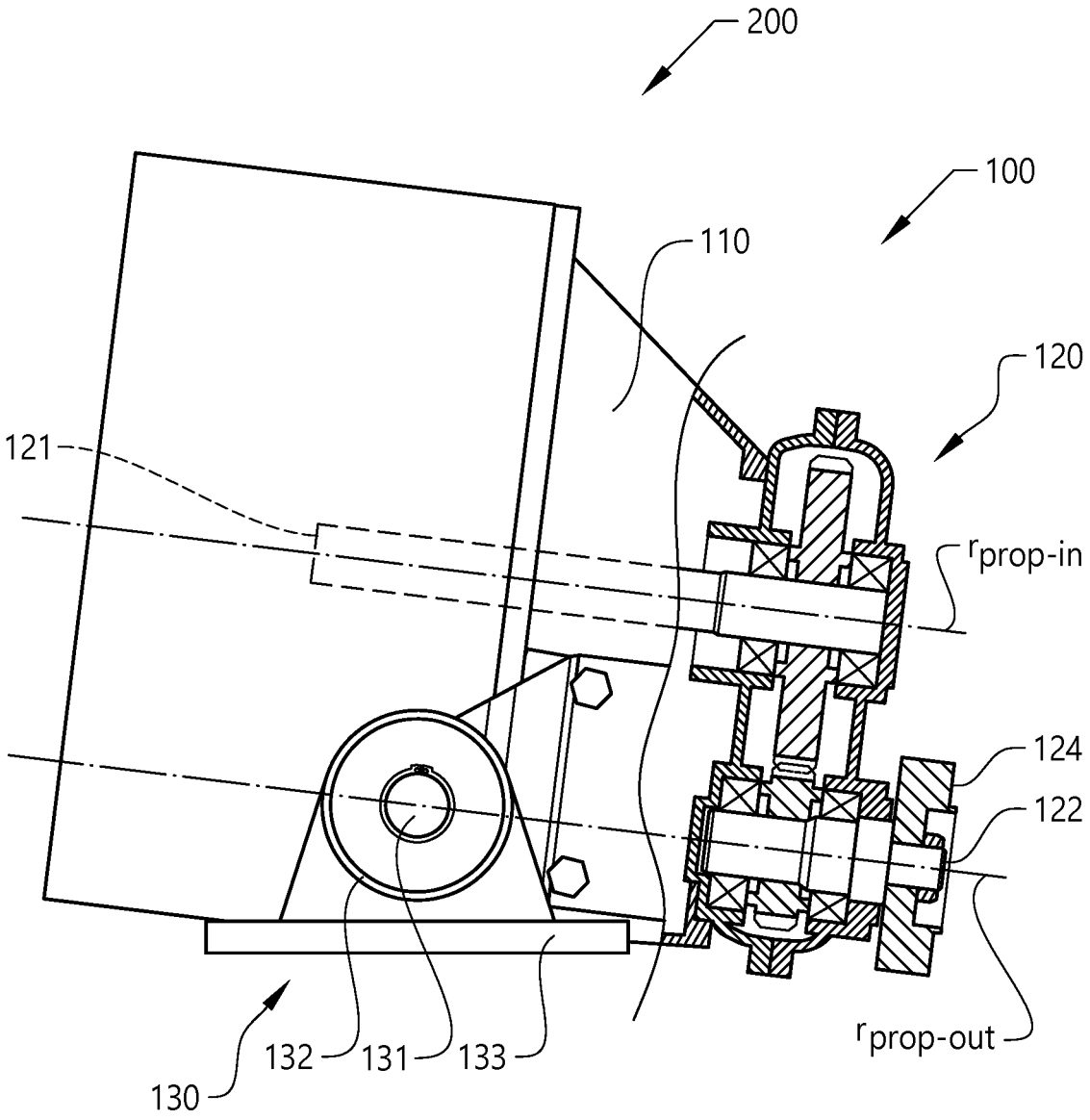
FIG. 5 is a schematic illustration of the mounting arrangement for a propulsion unit comprising a drive arrangement according to some embodiments herein seen in the direction of a pivot axis.

FIG. 5 shows the mounting arrangement 100 comprising a drive arrangement 120 according to some further embodiments herein. The drive arrangement 120 may comprise a gear arranged between the input shaft 121 and the output shaft 122 for changing a speed and/or torque ratio between the input shaft 121 and the output shaft 122. The gear may e.g. be a planetary gear, in which the input shaft and the output shaft are arranged concentrically, as shown in FIGS. 1 to 4, or a meshing gear, in which the input shaft 121 and the output shaft 122 are arranged non-concentrically and are connected via respective cog wheels arranged on each shaft, as shown in FIG. 5. The mounting arrangement 100 shown in FIG. 5 comprises a drive arrangement 120 having an input shaft 121 mounted non-concentrically with the output shaft 122 and having a rotation axis $r_{prop_in}$ coinciding with a rotation axis of the output shaft of the propulsion unit when the propulsion unit is attached to the propulsion unit carrying arrangement 110. In the embodiment shown in FIG. 5 the pivot axis $r_{pivot}$ of the pivoting arrangement is preferably arranged to intersect the rotation axis $r_{prop_out}$ of the output shaft 122, in order to prevent a torque to be generated around the pivot axis $r_{pivot}$ when an axial force, such as e.g. a thrust force from the propeller shaft, is applied in the axial direction of the output shaft 122.

Figure 6:
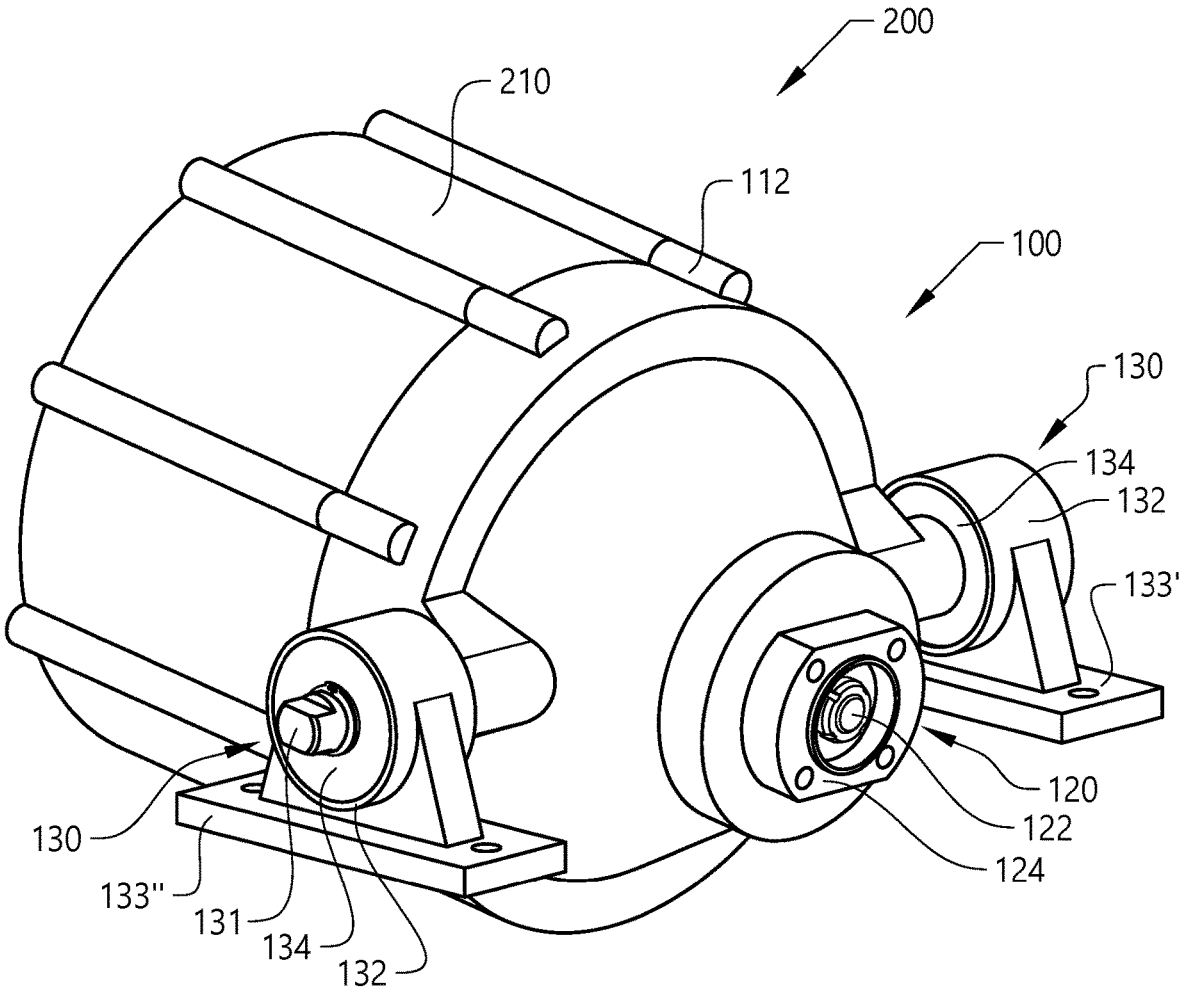
FIG. 6 is an illustration of the marine propulsion system according to some embodiments herein seen in perspective from a side adapted to receive the propeller shaft.

FIG. 6 shows a marine propulsion system 200 according to embodiments herein. The marine propulsion system 200 comprises the propulsion unit 210 and the mounting arrangement 100 according to the embodiments described herein. The propulsion unit carrying arrangement 110 carries said propulsion unit 210 such that said propulsion unit is rigidly attached to said propulsion unit carrying arrangement 110. The marine propulsion system 200 is configured to be drivingly connectable to the propeller shaft. The marine propulsion system is pivotably mountable to a marine vessel, e.g. by means of the pivoting arrangement 130. The propulsion unit 210 may e.g. be an electric motor, a combustion engine or a hydraulic motor. By allowing the marine propulsion system 200 to pivot in relation to a marine vessel different and/or flexible shaft inclines are possible, which facilitates the installation and alignment of the marine propulsion system 200 to the propeller drive.

The marine propulsion system 200 may be mounted to a vessel comprising a propeller drive 220 arranged at a certain inclination angle to the vessel. This may e.g. be the case when the propulsion unit 210 and the mounting arrangement 100 have been removed from a vessel for maintenance purposes. At reinstallation of the propulsion unit 210 and the mounting arrangement 100 in the vessel, the angle of inclination of the propulsion unit 210 may be aligned with the inclination angle of the propeller shaft, since the propulsion unit can be pivoted in relation to the mounting arrangement. When the propeller shaft is drivingly connected to the propulsion unit 210, e.g. by being directly connected to the propulsion unit 210 or by being connected to the output shaft 122 of the gear arrangement 120, the angle of inclination of the propulsion unit 210 and/or the output shaft 122 will be determined by the propeller shaft. The propeller shaft will thus be automatically aligned with the propulsion unit 210 and/or the output shaft 122.

The marine propulsion system 200 may further comprise the propeller drive 220, which in turn comprises the propeller shaft 221. The propulsion unit carrying arrangement 110 carries the propulsion unit 210 such that said propulsion unit 210 is rigidly attached to said propulsion unit carrying arrangement 110 and an output shaft of the propulsion unit 210 is drivingly connected to said propeller shaft of the propeller drive. The propeller shaft may be drivingly connected to the propulsion unit 210 of the marine propulsion system 200, e.g. by being directly connected to the propulsion unit 210 or by being connected to the output shaft 122 of the gear arrangement 120. Thereby, the propulsion unit 210 and the propeller shaft may be assembled and aligned prior to mounting the marine propulsion system to a marine vessel 300, and may be mounted as one unit in a hull of a marine vessel. Due to the propulsion unit carrying arrangement 110 being pivotable in relation to the attachment arrangement, the angle of inclination of the marine propulsion system 200 may be continuously adapted within the predetermined range to allow the propeller shaft to be mounted with a desired inclination to the hull of the vessel, without having to realign the propeller shaft and the propulsion unit 210.

Figure 7:
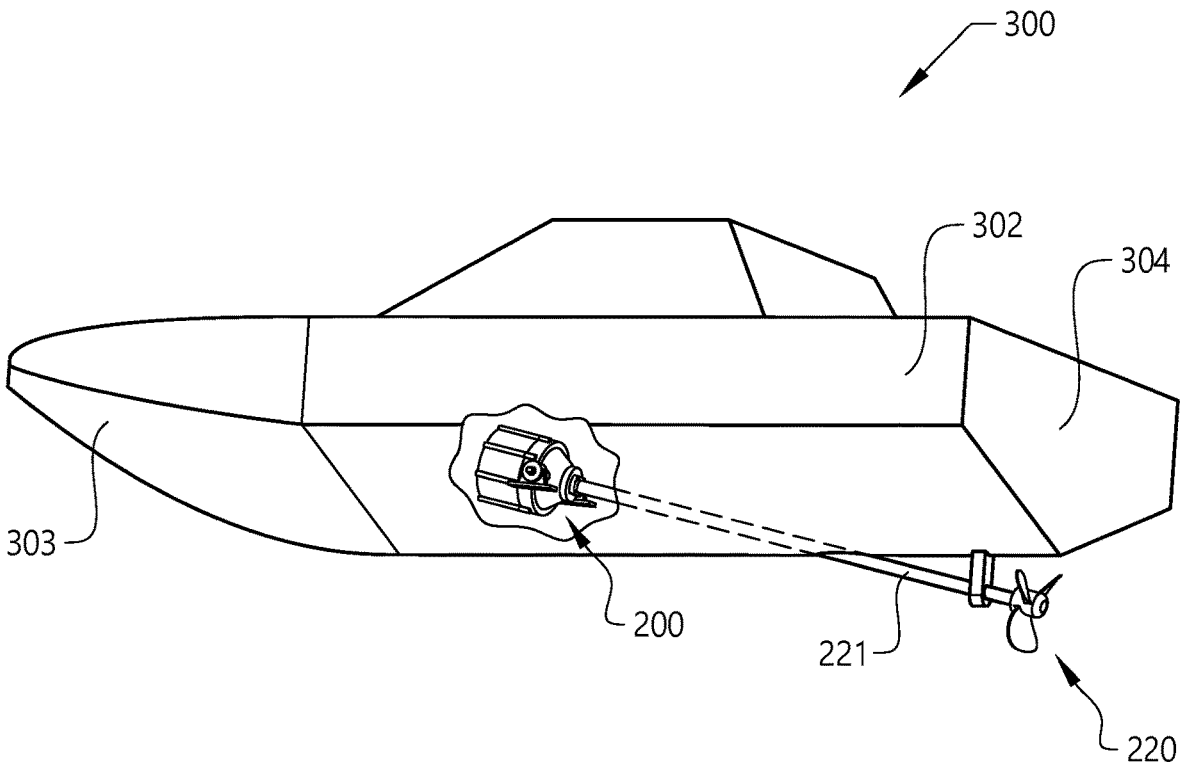
FIG. 7 is an illustration of a marine vessel comprising the marine propulsion system according to embodiments herein.

FIG. 7 shows an overview of a marine vessel 300, such as e.g. a boat or a ship, according to some embodiments herein. The marine vessel 300 comprises a hull 302 having a forward facing bow 303 and a backward facing stern 304. The marine vessel 300 further comprises the marine propulsion system 200 according to the embodiments described herein and the propeller drive 220 connected to the marine propulsion system 200. The propeller drive 220 comprises one or more propellers 222 mounted on the propeller shaft 221 of the propeller drive 220. The propeller shaft 221 is drivingly connected to the propulsion unit 210 of the marine propulsion system 200, e.g. by being directly connected to the propulsion unit 210 or by being connected to the output shaft 122 of the gear arrangement 120. The marine propulsion system may e.g. be mounted in the hull 302 of the marine vessel 300. Although FIG. 7 shows the vessel 300 comprising one marine propulsion system 200 and one propeller drive 220, the vessel 300 may also comprise a plurality of propulsion systems 200 and propeller drives 220.

Since the propulsion unit carrying arrangement 110 is pivotably connected to the attachment arrangement 133, the inclination angle of the output shaft of the propulsion unit and/or the output shaft 122 of the gear arrangement 120 may be continuously adapted to the inclination angle of the propeller shaft 221 in relation to the hull of the marine vessel 300. Thereby, the installation and alignment of the marine propulsion system 200 is facilitated. The marine propulsion system 200 may be mounted to the hull 302 of the marine vessel 300 by means of the attachment arrangement 133, the inclination angle $\alpha_i$ of the propulsion unit carrying arrangement 110 may subsequently be adapted to align with the propeller shaft 221. When the propeller shaft 221 is drivingly connected to the propulsion unit 210, either directly or via the gear arrangement 120, the propulsion unit carrying arrangement 110 will automatically be aligned to the inclination angle of the propeller shaft 221 since the propulsion unit carrying arrangement 110 can continuously pivot around the pivot axis within the predetermined range of angles. The inclination angle will be determined by the angle in which the propeller shaft is connected to the hull 302 of the vessel 300. Hence, the alignment of the propulsion unit 210 to the propeller shaft 221 can be performed without having to manually change the height of a plurality of mounting points for the propulsion unit 210 and/or the propeller shaft 221.

The marine propulsion system 200 may e.g. be mounted to the marine vessel by attaching the attachment arrangement 133 to the marine vessel by means of fixation means, such as e.g. one or more screws, bolts, rivets and/or welds. The screws and the bolts have the benefit that they are removable and thus allows the attachment arrangements to be removably mounted to the marine vessel. The rivets and the welds on the other hand have the benefit that they are rigid and thus reduce the risk of the fixation means being undone due to vibrations generated by the propulsion unit or a propeller drive, when the propulsion unit or propeller drive are connected to the mounting arrangement 100.

The propeller drive 220 may comprise one or more propellers. The propeller(s) may be arranged in either a pulling or pushing configuration. The propellers may also be arranged in a counter-rotating configuration. Pulling configuration shall herein be interpreted as being mounted in a forward facing direction when mounted on a marine vessel, while pushing configuration shall be interpreted as being mounted in a rearward facing direction when mounted on a marine vessel. Having counter-rotating propellers reduce vibrations of the propulsion system. By having propellers in a pulling configuration, the propellers can work in undisturbed water which increases the performance of the propulsion system 200.

The marine propulsion system 200 according to the embodiments herein provides a propulsion system that is easy to install in an inboard configuration on a marine vessel and can be easily adapted to different propeller shaft angles. According to some embodiments herein the flexible elements further absorbs vibrations and noise from the propulsion unit and the propeller drive and thus reduces the vibrations and the noise transferred to the marine vessel.

The invention claimed is:

1. A mounting arrangement for a propulsion unit, comprising:

an attachment arrangement adapted to attach said mounting arrangement to a marine vessel, a propulsion unit carrying arrangement adapted to carry said propulsion unit such that said propulsion unit is rigidly attached to said propulsion unit carrying arrangement, said propulsion unit carrying arrangement being pivotably connected to said attachment arrangement, the mounting arrangement further comprising a pivoting arrangement for obtaining the pivotable connection between the propulsion unit carrying arrangement and the attachment arrangement, the pivoting arrangement comprising a first pivoting element forming part of the propulsion unit carrying arrangement and a second pivoting element forming part of the attachment arrangement, the first and second pivoting elements being pivotably connected to each other, such that the propulsion unit carrying arrangement is pivotable in relation to the attachment arrangement by means of the first and second pivoting elements, wherein the propulsion unit carrying arrangement is adapted to receive a propeller shaft of a propeller drive, such that the propeller shaft is drivingly connectable to said propulsion unit, and wherein the propulsion unit carrying arrangement comprises a drive arrangement, wherein the drive arrangement comprises an input shaft being drivingly connectable to an output shaft of the propulsion unit and an output shaft being drivingly connectable to the shaft of the propeller drive, and wherein the input shaft and the output shaft are drivingly connected to each other, characterized in that the drive arrangement comprises a gear arranged between the input shaft and the output shaft, wherein the gear is a meshing gear, in which the input shaft and the output shaft are arranged non-concentrically and are connected via respective cog wheels arranged on each shaft, wherein the input shaft is having a rotation axis ($r_{prop_in}$) coinciding with a rotation axis of the output shaft of the propulsion unit when the propulsion unit is attached to the propulsion unit carrying arrangement, and wherein a pivot axis ($r_{pivot}$) of the pivoting arrangement is arranged to intersect a rotation axis ($r_{prop_out}$) of the output shaft.

2. The mounting arrangement according to claim 1, wherein the first pivoting element is an axle, and the second pivoting element comprises a tubular sleeve for receiving the axle.

3. The mounting arrangement according to claim 1, wherein the second pivoting element is an axle, and the first pivoting element comprises a tubular sleeve for receiving the axle.

4. The mounting arrangement according to claim 1, wherein the pivoting arrangement further comprises a flexible element for separating the first pivoting element from the second pivoting element, when the first pivoting element is connected to the second pivoting element.

5. The mounting arrangement according to claim 1, wherein the mounting arrangement is such that the propulsion unit carrying arrangement is adapted to pivot relative to said attachment arrangement around a pivot axis ($r_{pivot}$) being perpendicular to a rotation axis ($r_{prop}$) of the propeller shaft when the propeller shaft is drivingly connected to said propulsion unit.

6. The mounting arrangement according to claim 5 wherein the attachment arrangement comprises two attachment members and two pivoting arrangements, wherein the pivoting arrangements are arranged on opposite sides of the propulsion unit carrying arrangement, and wherein the pivot axes of the two pivoting arrangements are arranged collinear to each other and perpendicular to a rotation axis of the propeller shaft when the propeller shaft is drivingly connected to said propulsion unit.

7. The mounting arrangement according to claim 5, wherein the pivot axis ($r_{pivot}$) intersects the rotation axis of the propeller shaft when the shaft of the propeller drive is drivingly connected to said propulsion unit.

8. A marine propulsion system comprising a propulsion unit and the mounting arrangement according to claim 1, wherein the propulsion unit carrying arrangement carries said propulsion unit such that said propulsion unit is rigidly attached to said propulsion unit carrying arrangement and wherein an output shaft of the propulsion unit is drivingly connectable to a propeller shaft.

9. The marine propulsion system according to claim 8, further comprising a propeller drive, which in turn comprises a propeller shaft, wherein an output shaft of the propulsion unit is drivingly connected to said propeller shaft.

10. The marine propulsion system according to claim 8, wherein the propulsion unit is an electric motor, a combustion engine or a hydraulic motor.

11. A marine vessel comprising a hull and a marine propulsion system according to claim 8, wherein the propulsion unit is pivotably mounted to the hull of the marine vessel.

* * * * *